United States Patent [19]

Beckenstein

[11] 4,240,273

[45] Dec. 23, 1980

[54] METHOD OF KNITTING AND KNITTING MACHINE ARRANGEMENT THEREFOR

[76] Inventor: Leonard Beckenstein, 15 Farm Rd., St. James, N.Y. 11780

[21] Appl. No.: 890,290

[22] Filed: Mar. 27, 1978

[51] Int. Cl.[2] ..... D04B 15/76

[52] U.S. Cl. ..... 66/42 R; 66/229

[58] Field of Search ..... 66/25, 40, 50 A, 50 B (U.S. only), 66/42

[56] References Cited

U.S. PATENT DOCUMENTS

| | | | |
|---|---|---|---|
| 1,541,230 | 6/1925 | Lombardi | 66/42 |
| 2,030,815 | 2/1936 | Feinman | 66/50 A |
| 2,127,224 | 8/1938 | Lombardi | 66/50 A |
| 3,075,372 | 1/1963 | Philip | 66/50 A |
| 3,122,905 | 3/1964 | Gutschmit | 66/50 A |
| 3,145,548 | 8/1964 | Mishcon | 66/50 A |
| 3,224,227 | 12/1965 | Beckenstein | 66/50 A |
| 3,464,234 | 9/1969 | Carrotte | 66/25 |

FOREIGN PATENT DOCUMENTS

| | | | |
|---|---|---|---|
| 272307 | 6/1927 | United Kingdom | 66/50 A |

*Primary Examiner*—Wm. Carter Reynolds

*Attorney, Agent, or Firm*—Lackenbach, Lilling & Siegel

[57] ABSTRACT

A knitting machine arrangement and a method of knitting on the same are described which utilize a pair of stacked pattern wheels at each knitting station of a circular knitting machine. By alternating high and low butt knitting needle groups in successive slots of one portion of the cylinder, a singular pattern or design can be knitted by inserting appropriate jacks in the upper and lower pattern wheels which engage the associated needle groups. When the order of the high butt and low butt needles is reversed on another portion of the cylinder, alternate slots and, therefore, jacks of the pattern wheels are engaged and these may produce a different pattern or design. By dividing patterns between the upper and lower pattern wheels at each station, desired effects, such as spotting, design or pattern enlargement may be achieved by selectively placing needle groups about the periphery of the cylinder.

14 Claims, 8 Drawing Figures

METHOD OF KNITTING AND KNITTING MACHINE ARRANGEMENT THEREFOR

BACKGROUND OF THE INVENTION

The present invention generally relates to the art of knitting, and more specifically to a method and knitting machine arrangement for knitting on a circular knitting machine utilizing stacked pattern wheels at feeding stations and selective placement of needles having high and low butts.

The knitting machine art is an old one and numerous approaches have been proposed and used to knit fabrics having desired patterns or designs.

A frequently used knitting machine is the circular knitting machine which utilizes pattern wheels each of which is programmed to correspond to a desired effect in the finished fabric. The pattern wheels are, therefore, in the nature of storage devices which store pattern data and engage and cooperate with associated knitting needles to position the same in desired positions in the knitting process at preselected periods of the knitting cycle. The manner in which circular knitting machines operate, and the manner in which the pattern wheels actuate knitting needles is well known to those skilled in the art. Illustrative of the state of the art in this respect include the following U.S. Pat. Nos.: 2,006,821; 2,008,810; 2,055,598; 2,055,599; 2,203,711; 2,539,790; 2,627,172; 2,941,383; 3,274,800; 2,457,736 and 3,858,414. Other patterning mechanisms for circular and other knitting machines are also known, some illustrative U.S. patents in this area being as follows: Nos. 2,928,266; 3,077,756; 3,166,920 and 3,167,939. A problem which has existed with some prior art circular knitting machines is the limitation of the pattern area, namely the relatively limited number of knitting needles which may be controlled during each repeat of the preselected pattern. Furthermore, in some prior art machines, the pattern must be repeated each time the pattern wheel completes one revolution.

Aside from the above-described problem relating to pattern width, many circular knitting machines pose the additional problem that unless the number of slots provided in the pattern wheels bear a certain relationship to the number of needles inserted in the cylinder of the machine, successive patterns occur with a shift therebetween. Specifically, unless the number of needles divided by the number of slots in the pattern wheel is a whole number, a shift occurs since the pattern wheel rotates less than a whole number of times relative to the needles. The shift that occurs in the pattern becomes more pronounced and usually is more objectionable in utilizing the fabric for preparing articles, such as garments, and the like. The fabric made with a pattern shift, known as spiraling, is limited in its versatility and usefulness for making garments since the position of the pattern must be taken into account in cutting the fabric.

With single knit machines which utilize one pattern wheel per knitting station, the pattern has to be repeated after each turn of the pattern wheel, producing all-over patterns. To give any height to the pattern, the pattern is divided in the wheel and through an uneven number of pattern wheel turns with relation to the needles in the cylinder, parts of the divided pattern in the wheel repeat above the other parts producing the effect of a taller but thinner pattern on the knitted cloth. This system produces, however, the patterns in a spiraling fashion as suggested above. Single knit Jacquard machines produce cloth using three positions of needle height. The normal knit and miss positions produce the pictorial pattern and the tuck position "ties" the yarns that are floated across the back into the cloth. Double knit machines with large Jacquard design mechanisms other than pattern wheels are capable of placing the patterns and producing a pattern with no spiral. These machines use two positions, knit and miss, to produce the design and the yarns floated between the knit areas are knitted into the cloth on the second bed of needles.

Single knit pattern wheel machines have been the only practical means of producing Jacquard patterns on knitted cloth because of their three position capability, but heretofore could only make all over spiraling designs.

The flexibility of a circular knitting machine to generate quality knitted fabrics having desired patterns or designs is to a great extent a function of the gage of the machine and the ability of the machine to control a large number of knitting needles during each repeat of the pattern. An early attempt to achieve an enhanced fineness of stitching is disclosed in U.S. Pat. No. 2,030,815 for a "Knitting Machine" to Feineman. This patent discloses a circular knitting machine having a plurality of banks of needles with cams or butts at different levels, each of which bank of needles cooperate with a corresponding bank or series of pattern wheels. While Feineman discloses the use of stacked pattern wheels at a feeding station, this is specifically for the purpose of providing a wider range of regulation of tightness or looseness of the stitch without excessively decreasing the tightness of the vanes or teeth of the pattern wheels which would weaken the teeth and possibly result in their becoming damaged during operation.

An attempt to provide a knitting machine which produces patterns which are not shifted vertically or horizontally, but in alignment in these directions, was described in U.S. Pat. No. 3,122,905 entitled "Knitting Machine" to Gutschmit. Another object of the Gutschmit machine was to permit several patterns to be simultaneously knitted during each revolution of the cylinder, each of which patterns may extend through several revolutions. To achieve these objects, the Gutschmit Knitting Machine utilized long and short needles which were carried on a rotatable cylinder of the machine. The needles were adapted to be raised separately and in synchronism therebetween by slotted pattern wheels disposed in their rotating path. The slots of the pattern wheels were filled with jacks or left empty for forming a pattern. In addition, since the long and short needles knit separately, one set of needles could be made to be operative over the knitting period when the other set of needles could introduce the shift, so that the shift did not occur. Alternately, a pattern with a shift could be produced, if desired, by selecting a combination of long and short needles. However, in order to achieve his objects, Gutschmit had to use special jacks slidably mounted within the cylinder slots or stacked cylinders as disclosed in the Gutschmit patent. A cylinder having a double height was required, this clearly increasing the expense of manufacturing the Gutschmit Knitting Machine as well as complicating its construction, operation and maintenance.

Another attempt to provide a needle selecting device for patterning knit fabrics which remains unaltered during the operation of the knitting machine which provides a pattern area of knitting needles is described in U.S. Pat. No. 3,145,548 for "Pattern Mechanism for Circular Knitting Machines" to Mishcon. The Mishcon knitting machine included a circular arranged bank of evenly spaced knitting needles divided into groups having common-height butts. Three pattern wheels were stacked at a feeding station, each pattern wheel being arranged to engage one of the groups of knitting needles. More specifically, the highest pattern wheel on the stack being arranged to engage the highest butt needles, the lowest pattern wheel being arranged to engage the lowest butt needles and the intermediate pattern wheel being arranged to engage the intermediate butt needles. In order to enlarge the pattern area, Miscon required that each of the pattern wheels have a total number of jack accommodating slots which was not divisible exactly by any prime factor of the number of groups of knitting needles. However, the only way that Mishcon could use all the slots in the pattern wheels was to make an odd number of slots as noted. With the arrangement disclosed, Mishcon only teaches knitting of fabric having a uniform allover design or pattern which is wider than could normally be achieved with a single pattern wheel. However, Mishcon does not discuss the possibility of spotting a fabric or knitting two separate and distinct designs on selected portions of the fabric.

The present invention also utilizes stacked pattern wheels at each feeding station but overcomes the above-noted disadvantages inherent in the prior art knitting machines. The knitting machine of the present invention makes it possible to produce two patterns instead of one and to be able to place each pattern wherever desired. This can be achieved in a simple and inexpensive manner and does not require knitting machines having excessively high cylinders. In the present invention, it is also possible to produce two patterns and join them, by placement, to produce one pattern which is larger than the ones previously produced, and the resulting pattern does not exhibit the undesirable spiral effect. Additionally, the knitting machine of the invention makes it possible to place a pattern upon a plain background (which is actually another pattern) to achieve the effect of spotting the pattern in any desired manner along a vertical or longitudinal direction of the cloth.

SUMMARY OF THE INVENTION

Accordingly, it is an object of the present invention to provide a knitting machine which does not possess the disadvantages described above in connection with other prior art knitting machines.

It is another object of the present invention to provide a knitting machine simple in construction and economical to manufacture.

It is still another object of the present invention to provide a knitting machine which can produce a fabric having patterns which are not shifted or which do not exhibit a spiraling effect.

It is yet another object of the present invention to provide a knitting machine which utilizes stacked pattern wheels which share design or pattern information and which selectively permit placing of one pattern against another, enlarging the size or width of a pattern, or placing a pattern on a plain background by placement of groups of knitting needles which are arranged to alternately engage the pattern wheels of the stacked pattern wheel sets at each feed station.

It is a further object of the present invention to provide a knitting machine which makes it possible to achieve the last object while providing a number of slots in the knitting machine cylinder which is a direct multiple of the number of slots in each of the respective pattern wheels so that there are no extra slots or relative displacements between the pattern wheels and the cylinder during each successive revolution of the same.

It is still a further object of the present invention to provide a method of knitting which utilizes the knitting machine in accordance with the present invention.

In order to achieve the above objects, as well as others which will become apparent hereafter, a knitting machine in accordance with the present invention comprises a cylinder provided with a first predetermined number of uniformly spaced slots about the periphery thereof. A plurality of knitting needles are provided which are arranged within said cylinder slots, each knitting needle having a hook formed thereon and a butt in spaced relation to the hook. Said knitting needles are arranged in said cylindrical slots in a plurality of like groups, the needles of each group having a common spacing between the needle hooks and butts which is different from that of the other groups. At least one yarn feeding station for said knitting needles is provided and a plurality of stacked pattern wheels are provided at each yarn feeding station. Each pattern wheel at each feeding station is arranged to engage only the knitting needles of one of said knitting needle groups, said pattern wheels each being provided with a second predetermined number of jack accommodating uniformly spaced slots at least as closely spaced as said cylinder slots. Said cylinder and pattern wheel slots form a plurality of slot groups, corresponding slot groups on said cylinder and pattern wheels normally continuing to register with each other with relative movements between said cylinder and pattern wheels. Knitting needles of one knitting needle group are arranged in a cylinder first slot group to cooperate with a first slot group of one corresponding pattern wheel over at least one portion of said cylinder. Knitting needles of another group of knitting needles are arranged in said cylinder first slot group to cooperate with a first slot group of another corresponding pattern wheel over at least another portion of said cylinder. In this manner, the same slot groups in said cylinder can contain knitting needles of different needle groups to selectively engage jacks placed in corresponding slot groups of different ones of said stacked pattern wheels and control the nature of the knitted pattern by selective knitting needle group placement.

In a circular knitting machine wherein stacked pattern wheels are provided as suggested above, the method in accordance with the present invention comprises the steps of arranging needles on one knitting needle group in a cylinder first slot group to cooperate with a first slot group of one corresponding pattern wheel over at least one portion of said cylinder. Knitting needles of another group of knitting needles are arranged in said cylinder first slot group to cooperate with a first slot group of another corresponding pattern wheel over at least another portion of said cylinder.

BRIEF DESCRIPTION OF THE DRAWINGS

These and other objects and advantageous features of the invention will be described in greater detail subsequently with reference to the following drawings, wherein.

DESCRIPTION OF THE PREFERRED EMBODIMENT

Figure 1:
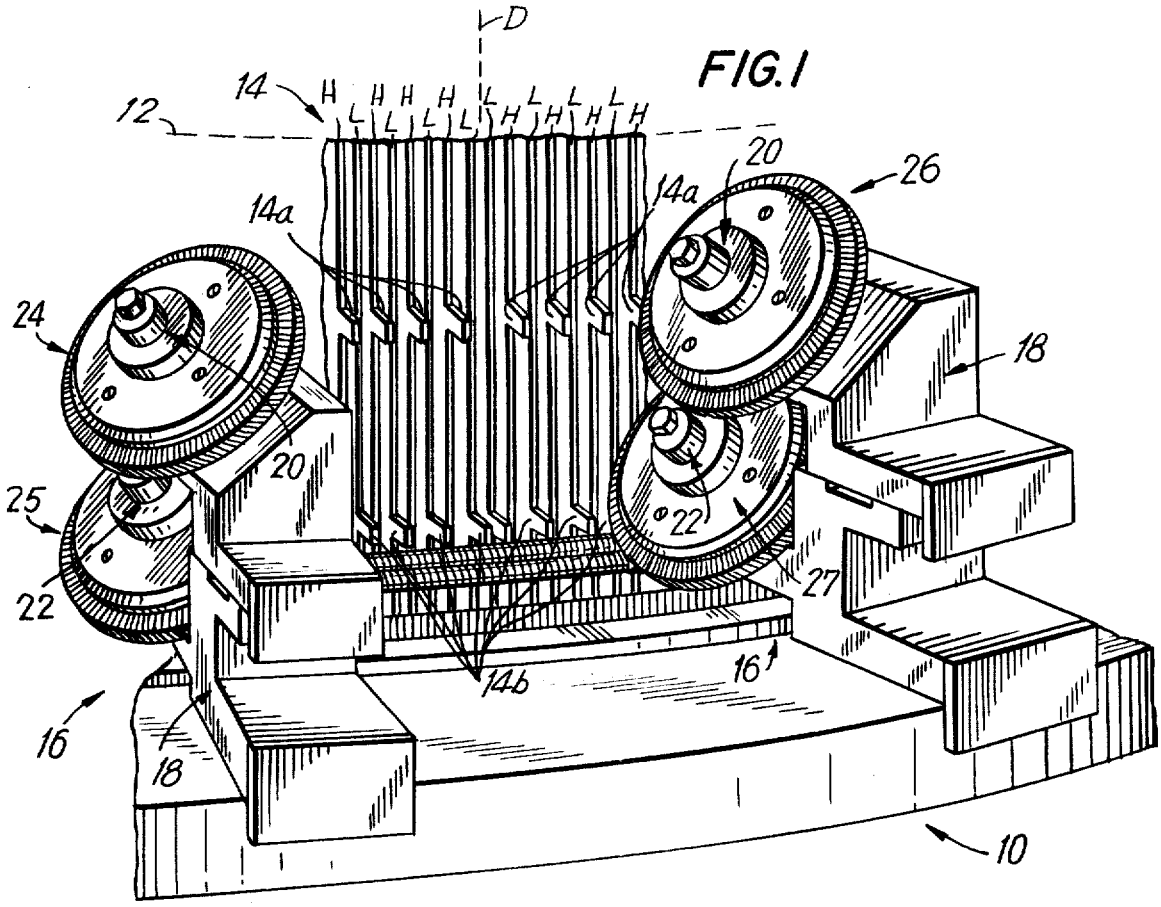
FIG. 1 is a fragmented view, in perspective, of a knitting machine in accordance with the present invention, showing stacked pattern wheels at each feed station and selective placement of two knitting needle groups separated at a demarcation line to form a desired fabric pattern or design.

Referring now to the figures, in which identical or similar parts are designated by the same reference numerals throughout, important features of the present invention will be described without describing in detail the general operation of a circular knitting machine utilizing circular pattern wheels. Such general operation is well known to those skilled in the art, and is described in the above-identified patents. To the extent that the operations of the circular knitting machines are similar to the operation of the present invention, the teachings in the following U.S. patents are incorporated herein: Nos. 3,122,905, 3,145,548; and 3,403,535.

Figure 2:
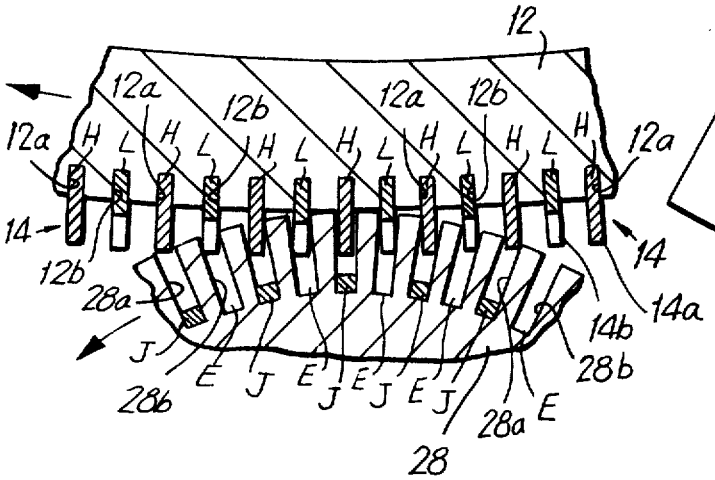
FIG. 2 is a fragmented schematic representation of one pattern wheel of a set of stacked pattern wheels and the manner in which it engages the knitting needles in the cylinder.
Figure 3:
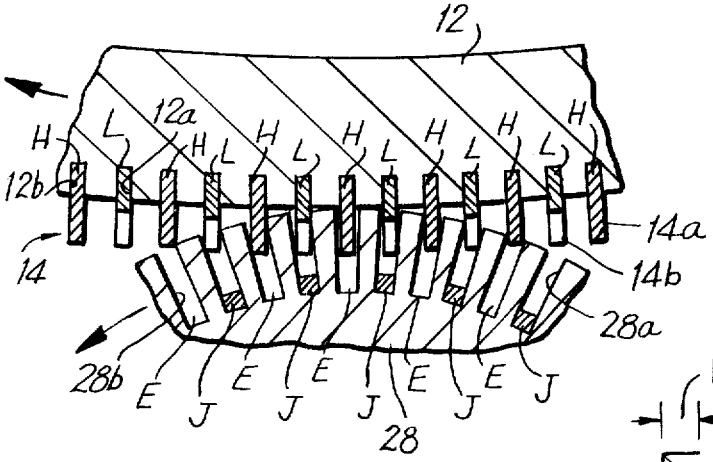
FIG. 3 is similar to FIG. 2, but showing the other pattern wheel opposite on a different portion of the cylinder and the manner in which it engages the alternate needles arranged in the cylinder.

A circular knitting machine in accordance with the present invention is generally identified by the reference numeral 10. Referring to FIGS. 1–3, the knitting machine 10 includes a cylinder 12 provided with a plurality of slots about the periphery thereof in a well known or conventional manner. Alternate slots in the cylinder 12 have been designated by the reference numerals 12*a* and 12*b* forming separate groups of slots. A predetermined number of uniformly spaced slots are provided in the cylinder, this being a function of the gage of the machine.

A plurality of knitting needles 14 are arranged within the cylinder slots 12*a* and 12*b*. While not shown in the drawings, each knitting needle has a hook formed thereon and a butt in spaced relation to the hook in a well known manner. The knitting needles 14 are arranged in the cylinder slots in a plurality of like groups changing over from one group to another, for example, at demarcation line D, the needles of each group having a common spacing between the needle hooks and butts which is different from that of the other groups. As can best be seen in FIG. 1, knitting needles are alternated in the cylinder so that successive needles have high butts 14*a* and low butss 14*b*. The needles have further been identified by the letters "H" and "L" more clearly designate that successive needles along the periphery of the cylinder alternate in the positions of their respective butts.

Disposed about the periphery of the cylinder 12 are a plurality of yarn feeding stations for the knitting needles 14. Feeding stations 16, 16*a* are shown. However, as would be evident to those skilled in the art, additional feeding stations are provided.

At each feeding station there is provided a support block or mount 18 which supports generally parallel axles or shafts 20, 22 as shown.

At the feeding station 16, a top pattern wheel 24 is mounted on the shaft 20, while a lower pattern wheel 25 is mounted on the shaft 22. Similarly, a pattern wheel 26 is mounted on the top shaft 20 at the feeding station 16*a* and a pattern wheel 27 is mounted on the shaft 22 at such feeding station.

Each pattern wheel at each feeding station is arranged to engage only the knitting needles of one of the knitting needle groups. Therefore, the high butts 14*a* are arranged and adapted to engage only the upper pattern wheels 24,26 while the low butts 14*b* are adapted only to engage the lower pattern wheels 25 and 27.

Pattern wheels 24-27 have a predetermined number of jack accommodating uniformly spaced slots as suggested in FIGS. 2 and 3, which are equally spaced as the cylinder slots.

The cylinder and pattern wheel slots form a plurality of slot groups, corresponding slot groups on the cylinder 12 and pattern wheels normally continuing to register with each other with relative movements between the cylinder and the pattern wheels.

Referring to FIG. 2, it will be assumed that the cylinder slots 12*a* are even slots of the cylinder, while the slots 12*b* are the odd cylinder slots. Under these circumstances, high butt needles are shown disposed within the even cylinder slots and low butt needles in the odd cylinder slots.

Looking at a single pattern wheel 28 in FIG. 2, slots 28*a* are shown to be filled with jacks, which are designated by the letter "J". The pattern wheel slots 28*b* being shown to be empty. For purposes of the discussion, the pattern wheel slots 28*a* will also be designated as being even slots of the pattern wheel and the slots 28*b* as the odd slots.

In one important operating condition of the knitting machine in accordance with the present invention, the even cylinder slots remain aligned with the even slots of the pattern wheel and the same applies for the odd slots of the cylinder and pattern wheel during the continued operation of the knitting machine. Under these circumstances, there is no relative shift of the pattern wheels relative to the cylinder upon the completion of each revolution.

When the jacks "J" are programmed or arranged in the pattern wheel 28 to provide a predetermined pattern or design, the pattern will be knitted by the actuation of the high butt needles 12*a* with the jacks "J" during each revolution of the pattern wheels. The low butt needles 12*b* in FIG. 2 will not engage the pattern wheel 28 since they are physically located below the pattern wheel 28 and hence cannot engage any jacks within the pattern wheel 28 even if such jacks were placed within the empty pattern wheel slots 28*b*, identified by the letter "E". With this arrangement, the pattern wheel 28 will control only the high butt needles 12*a* which, in the presently preferred embodiment, alternate with low butt needles 12*b* about the periphery of the cylinder 12.

The needles 14 shown in FIG. 2 can be arranged as described over a portion of the cylinder. As many or as few needles can be arranged as shown with the high butt needles being positioned within the even slots and the low butt needles within the odd slots of the cylinder. As described, this will result in a pattern being knitted as a result of the high butt needles engaging the jacks placed within the even slots 28*a* of the pattern wheel 28. However, it is contemplated by the present invention that over a different or other portion of the cylinder, the needles 14 are reversed in order so as to place the high butt needles 14*a* within the odd slots 12*b* of the cylinder 12 and the low butt needles 14*b* in the even slots 12*a* of the cylinder. However, since the slots of the cylinder 12 and the pattern wheel 28 remain aligned, so that even and odd slots respectively continue to be aligned with each other, it will be readily evident that the high butt needles, now in the odd slots of the cylinder 12, will enter or be received within the odd slots 28*b* of the pattern wheel 28. While the odd slots 28*b* in pattern wheel 28 have been shown empty, it should be clear to those skilled in the art that these pattern wheel slots can also be filled with patterning jacks. Accordingly, when the needles 14 are reversed so that the high and low butts are now in different alternate slots, the different sets of jacks in the alternate slots of the pattern wheels can come into play and correspondingly new patterns are knitted.

While the objects of the present invention can be achieved by using only a single pattern wheel at each feeding station, some fineness of the fabric is lost. Accordingly, it is advantageous to utilize two stacked pattern wheels as shown in FIG. 1 wherein two separate and distinct patterns are each programmed into each of the pattern wheels, one half of each pattern being provided on each pattern wheel. For example, one pattern can be programmed in the even slots of the upper pattern wheel and the odd slots of the lower pattern wheel. The other pattern can be programmed in the remaining slots of each of the pattern wheels. Now, each needle will be actuated during each revolution of the cylinder 12, one pattern being knitted when the butts engage the even slots of the upper pattern wheel and the odd slots of the lower pattern wheel over one portion of the cylinder. When a change in pattern design is desired, the order of the needles is reversed so that now the high butt needles engage the odd slots of the upper pattern wheel and the low butt needles engage the even slots of the lower pattern wheel.

Figure 4:
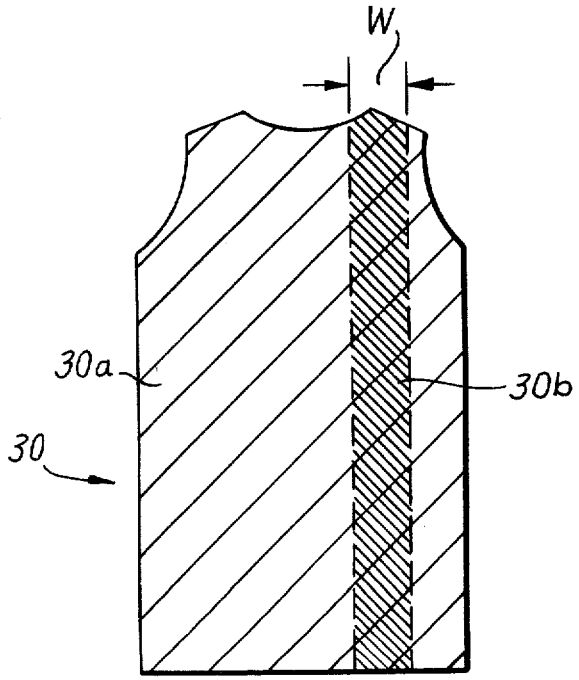
FIG. 4 illustrates a garment which may be knitted on a knitting machine in accordance with the present invention, wherein the pattern is selectively placed against the background of another pattern.

Using the above knitting machine and technique, a number of desirable knitted fabric pattern designs or effects can be achieved. Referring to FIG. 4, for example, there is shown a garment 30 which can be conveniently knitted with the present invention. For example, by arranging the knitting needles of one group, namely the ones with the high butts 14*a*, in the even slots and the needles of another group, those with the low butts 14*b*, in the odd slots of the cylinder 12, a first pattern or design 30*a* can be knitted when the upper and lower pattern wheels are appropriately coded with jacks. If a pattern or design 30*b* is desired over a width "W", a portion of the cylinder 12 which corresponds to that width can be provided with knitting needles which are reversed in their slots so that the low butt needles 14*b* are in the even slots of the cylinder and the high butt needles 14*a* are in the odd slots as suggested above. Over that width "W", therefore, a second pattern will be knitted when the corresponding pattern wheels are appropriately programmed.

Figure 5:
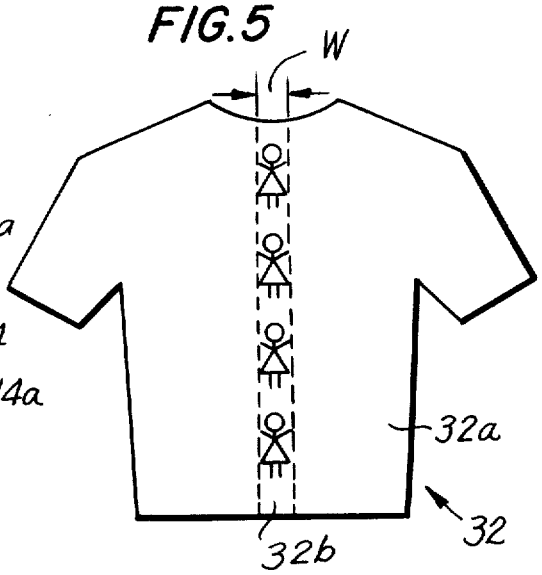
FIG. 5 is similar to FIG. 4, except that this Figure illustrates the ability of the present invention to spot a generally plain background with a desired pattern.
Figure 7:
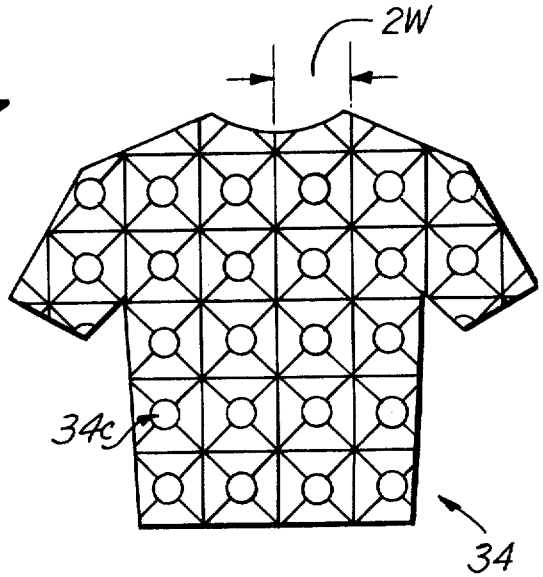
FIG. 7 is similar to FIGS. 4 and 5, and illustrates a garment knitted to provide a wider pattern area by successively combining the patterns illustrated in FIGS. 6*a* and 6*b*.
Figure 6A:
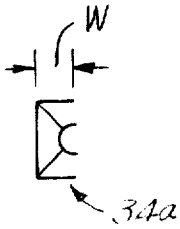
FIGS. 6*a* and 6*b* respectively show the left-hand and right-hand halves or portions of an overall pattern.
Figure 6B:
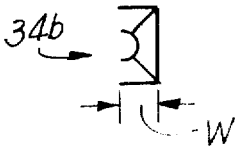

In FIG. 5, a similar effect as that described in connection with FIG. 4 can be achieved. Here, the garment 32 is provided with a plain background 32*a* which can be knitted over the major portion of the cylinder. Where a special design is to be spotted over a width "W", the pattern 32*b* can be achieved by again reversing the order to the needles 14 within the even and odd slots as described. A pattern or design area can be easily and conveniently enlarged by the present invention. Referring to FIGS. 6*a*, 6*b* and 7, there is shown a first pattern portion 34*a* having a width "W" and a second pattern portion 34*b* also having a width "W". If the groups of needles are arranged to first knit the pattern portion 34*a* and subsequently the pattern portion 34*b*, the two pattern portions combine to provide a pattern having twice the width "2W" as shown in FIG. 7. An overall enlarged pattern 34*c* can thus be achieved on a garment 34.

In order to enlarge the pattern area, the order of the knitting needles 14 are altered repeatedly about the periphery of the cylinder 12, each reversal taking place following a complete revolution of the pattern wheels. Thus, if one thousand needles are provided on the cylinder, and each pattern wheel has one hundred needles, the positions of the high butts 14*a* and low butts 14*b* are reversed in relation to the even and odd slots of the cylinder every one hundred slots of the cylinder. In this manner, the width "W" of each pattern portion 34*a* and 34*b* can be maximized to the capacity of each pattern wheel, and the two pattern portions are then combined by placing one pattern adjacent or following the other. In effect, then, the pattern width is doubled.

While only two pattern wheels have been illustrated and described, it should be clear to those skilled in the art, that three, four or any desired number of pattern wheels can be provided to practice the present invention. The same principles described above apply and the same patterning effects can be achieved.

With the present invention, synchronism of the pattern wheels is not a problem since the pattern wheels have every other slot engaging the butt of a needle, the wheels will stay synchronized with the cylinder. Of course, it is also possible to have the pattern wheels geared to the cylinder so that they remain synchronized in that manner. Special gearing arrangements are not, however, necessary with the present invention.

Other repeating arrangements of the needle groups are also possible. However, consideration must be given to the extent that the space between adjacent butts of any one group of needles cannot exceed that which will mesh simultaneously with the jack accommodating slots of the pattern wheel. The maximum spacing between the butts of the same group, such as high butts or low butts, will, of course, vary with the cut of the cylinder and with the diameter of the pattern wheel. In the most commonly used machines, a pattern wheel will mesh with approximately seven adjacent needles butts simultaneously. Therefore, as long as two needles of the same group are spaced no more than 5, 6 or 7 cylinder slots apart, the respective pattern wheel will remain in synchronism with the cylinder and with the other pattern wheels.

It is to be understood that the foregoing description of the presently preferred embodiment illustrated herein is exemplary and various modifications to the embodiment shown herein may be made without departing from the spirit and scope of the invention.

What is claimed:

1. A method of controlling a knitted pattern by arranging pattern wheels and needles on a knitting machine having a cylinder provided with a first predetermined number of uniformly spaced slots about the periphery thereof; a plurality of knitting needles arranged within said cylinder slots, each knitting needle having a hook formed thereon and a butt in spaced relation to the hook, said knitting needles being arranged in said cylinder slots in a plurality of like groups, the needles of each group having a common spacing between the needle hooks and butts which is different from that of the other groups; a plurality of yarn feeding stations for said knitting needles; the method comprising the steps of arranging a plurality of stacked pattern wheels at each yarn feeding station, each pattern wheel at each feeding station being arranged to engage only the knitting needles of one of said knitting needle groups, said pattern wheels each being provided with a second predetermined number of jack accommodating uniformly spaced slots equally spaced as said cylinder slots, said cylinder and pattern wheel slots forming a plurality of slot groups, corresponding slot groups on said cylinder and pattern wheels normally continuing to register with each other with relative movements between said cylinder and pattern wheels during the entire rotation of the cylinder; arranging needles of one of said knitting needle groups in a first of said cylinder slot groups to cooperate with a first of said pattern wheel slot groups of a corresponding one of said pattern wheels over at least one portion of said cylinder, and arranging knitting needles of another of said knitting needle groups in said first of said cylinder slot groups to cooperate with a first of said pattern wheel slot groups of a corresponding other of said pattern wheels over at least another portion of said cylinder, whereby the same slot groups in said cylinder can contain knitting needles of different knitting needle groups to selectively engage jacks placed in corresponding slot groups of different ones of said stacked pattern wheels and control the nature of the knitted pattern by selective knitting needle group placement.

2. A method as defined in claim 1, wherein said cylinder and pattern wheel slot groups comprise even and odd slots, and wherein said knitting needle groups include knitting needles having first and second height butts, said first height butt needles being inserted in said even cylinder slots and said second height butt needles being inserted in said odd cylinder slots over said at least one portion of said cylinder, and said second height butt needles being inserted in said even cylinder slots and said first height butt needles being inserted in said odd cylinder slots over said at least another portion of said cylinder.

3. A method as defined in claim 1, further comprising the steps of arranging the jacks in said first slot groups of said corresponding one of said pattern wheels to provide a first fabric pattern or design, and arranging the jacks in said first slot groups of said another corresponding pattern wheel to provide a second fabric pattern or design, whereby changing the knitting needle groups in said cylinder first slot group over at least a portion of said cylinder results in selective placing or spotting of a fabric with a second design or pattern which otherwise exhibits a first design or pattern.

4. A method as defined in claim 1, further comprising the steps of arranging the jacks in said first slot groups of said one corresponding pattern wheel to provide a first half of a fabric pattern or design, and arranging the jacks in said first slot groups of said another corresponding pattern wheel to provide a second half of said fabric pattern or design, whereby changing the knitting needle groups in said cylinder first slot group over portions of said cylinder which correspond to one-half of said second predetermined number results in doubling the width of a fabric pattern or design which could normally be obtained with one corresponding pattern wheel.

5. A method as defined in claim 1, further providing knitting needles of said another group within a cylinder second slot group over said at least one portion of said cylinder, and providing knitting needles of said one group within said cylinder second slot group over said at least another portion of said cylinder.

6. A method as defined in claim 5, wherein said knitting needles of said one and said another group of knitting needles are spaced from each other about said cylinder to assure that at least one knitting needle from each group always engages a respective one or associated pattern wheel, whereby said stacked pattern wheels are rotated in synchronism to maintain alignment of corresponding slot groups in said cylinder and said pattern wheels.

7. A method as defined in claim 1, further comprising the step of selecting said first and second predetermined numbers to provide one remaining cylinder slot after each complete revolution of said cylinder and corresponding number of complete revolutions of said pattern wheels, whereby the alignment of said first and second slot groups on said cylinder and pattern wheels changes after each full revolution of said cylinder.

8. A knitting machine comprising a cylinder provided with a first predetermined number of uniformly spaced slots about the periphery thereof; a plurality of knitting needles arranged within said cylinder slots, each knitting needle having a hook formed thereon and a butt in spaced relation to the hook, said knitting needles being arranged in said cylinder slots in a plurality of like groups, the needles of each group having a common spacing between the needle hooks and butts which is different from that of the other groups; a plurality of yarn feeding stations for said knitting needles; a plurality of stacked pattern wheels at each yarn feeding station, each pattern wheel at each feeding station being arranged to engage only the knitting needles of one of said knitting needle groups, said pattern wheels each being provided with a second predetermined number of jack accommodating uniformly spaced slots equally spaced as said cylinder slots, said cylinder and pattern wheel slots forming a plurality of slot groups, corresponding slot groups on said cylinder and pattern wheels normally continuing to register with each other with relative movements between said cylinder and pattern wheels during the entire rotation of the cylinder, knitting needles of one of said knitting needles groups being arranged in a first of said cylinder slot groups to cooperate with a first of said pattern wheel slot groups of a corresponding one of said pattern wheels over at least one portion of said cylinder, and knitting needles of another of said knitting needle groups being arranged in said first of said cylinder slot groups to cooperate with a first of said pattern wheel slot groups of a corresponding other of said pattern wheels over at least another portion of said cylinder, whereby the same slot group in said cylinder can contain knitting needles of different knitting needle groups to selectively engage jacks placed in corresponding slot groups of different ones of said stacked pattern wheels and control the nature of the knitted pattern by selective knitting needle group placement.

9. A knitting machine as defined in claim 8, wherein said cylinder and pattern wheel slot groups comprise even and odd slots and wherein said knitting needle groups include knitting needles having first and second height butts, said first height butt needles being provided in said even cylinder slots and said second height butt needles being provided in said odd cylinder slots over said at least one portion of said cylinder, and said second height butt needles being provided in said even cylinder slots and said first height butt needles being provided in said odd cylinder slots over said at least another portion of said cylinder.

10. A knitting machine as defined in claim 8, further comprising jacks in said first slot groups of said corresponding one of said pattern wheels to provide a first fabric pattern or design, and jacks in said first slot groups of said another corresponding pattern wheel to provide a second fabric pattern or design, whereby providing the knitting needle groups in said cylinder first slot group over at least a portion of said cylinder results in selective placing or spotting of a fabric with a second design or pattern which otherwise exhibits a first design or pattern.

11. A knitting machine as defined in claim 8, further comprising jacks in said first slot groups of said one corresponding pattern wheel to provide a first half of a fabric pattern or design, and jacks in said first slot groups of said another corresponding pattern wheel to provide a second half of said fabric pattern or design, whereby providing the knitting needle groups in said cylinder first slot group over portions of said cylinder which correspond to one-half of said second predetermined number results in doubling the width of a fabric pattern or design which could normally be obtained with one corresponding pattern wheel.

12. A knitting machine as defined in claim 8, further comprising knitting needles of said another group within a cylinder second slot group over said at least one portion of said cylinder, and knitting needles of said one group within said cylinder second slot group over said at least another portion of said cylinder.

13. A knitting machine as defined in claim 12, wherein said knitting needles of said one and said another group of knitting needles are spaced from each other about said cylinder to assure that at least one knitting needle from each group always engages a respective one or associated pattern wheel, whereby said stacked pattern wheels are rotated in synchronism to maintain alignment of corresponding slot groups in said cylinder and said pattern wheels.

14. A knitting machine as defined in claim 8, wherein said first and second predetermined numbers provide one remaining cylinder slot after each complete revolution of said cylinder and corresponding number of complete revolutions of said pattern wheels, whereby the alignment of said first and second slot groups on said cylinder and pattern wheels changes after each full revolution of said cylinder.

* * * * *